US011787663B1

(12) United States Patent
Monzon et al.

(10) Patent No.: US 11,787,663 B1
(45) Date of Patent: Oct. 17, 2023

(54) ELEVATOR CAR WITH ELECTRONIC SAFETY ACTUATOR

(71) Applicant: Otis Elevator Company, Farmington, CT (US)

(72) Inventors: Andres Monzon, Madrid (ES); Ariana Marco, Madrid (ES); Francisco Sanz, Madrid (ES); Antonio de Miguel Urquijo, Madrid (ES); Agustin Jimenez-Gonzalez, Madrid (ES); Juan-Antonio Illan, Madrid (ES); Luis Mena Rosell, Madrid (ES); Jose-Miguel Aguado-Martin, Madrid (ES); Luis Martí Sánchez, Madrid (ES); Juan Jose Fernandez, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/982,059

(22) Filed: Nov. 7, 2022

(30) Foreign Application Priority Data

May 5, 2022 (EP) ..... 22382432

(51) Int. Cl.
*B66B 5/18* (2006.01)
*B66D 5/30* (2006.01)

(52) U.S. Cl.
CPC . *B66B 5/18* (2013.01); *B66D 5/30* (2013.01)

(58) Field of Classification Search
CPC ..... B66B 5/18; B66B 11/002; B66B 11/0045
See application file for complete search history.

(56) References Cited

U.S. PATENT DOCUMENTS

| | | | |
|---|---|---|---|
| 9,809,420 | B2 | 11/2017 | Fauconnet et al. |
| 9,975,733 | B2 | 5/2018 | Cunningham et al. |
| 10,766,739 | B2 | 9/2020 | Fargo et al. |
| 11,104,545 | B2 | 8/2021 | Chao |
| 11,124,386 | B2 | 9/2021 | Fargo et al. |
| 2008/0053755 | A1 | 3/2008 | Lindberg |
| 2016/0280511 | A1 | 9/2016 | Anderson |
| 2017/0057783 | A1 | 3/2017 | Fargo et al. |
| 2017/0144862 | A1* | 5/2017 | Fernandez ..... B66B 1/3476 |
| 2017/0283216 | A1 | 10/2017 | Marvin |

(Continued)

FOREIGN PATENT DOCUMENTS

| | | | |
|---|---|---|---|
| CN | 102653371 | A | 9/2012 |
| CN | 103339052 | A | 10/2013 |

(Continued)

OTHER PUBLICATIONS

European Search Report for application EP 22382432.7, dated Nov. 8, 2022, 61 pages.

*Primary Examiner* — Diem M Tran
(74) *Attorney, Agent, or Firm* — CANTOR COLBURN LLP

(57) ABSTRACT

An elevator car (2, 2'), includes a first safety brake (8, 8'), including a first electronic safety actuator (512, 612), the first safety brake (8, 8') positioned on a first side of the elevator car (2, 2') at a first height (20, 20'); and a second safety brake (10, 10'), including a second electronic safety actuator (512, 612), the second safety brake (10, 10') positioned on a second side of the elevator car (2, 2') at a second height (22, 22'); the first height is different to the second height.

12 Claims, 6 Drawing Sheets

(56) References Cited

U.S. PATENT DOCUMENTS

| | | | |
|---|---|---|---|
| 2020/0048041 | A1 | 2/2020 | Fauconnet et al. |
| 2021/0130129 | A1 | 5/2021 | Kennedy et al. |

FOREIGN PATENT DOCUMENTS

| | | | | | |
|---|---|---|---|---|---|
| CN | 109132774 | A | | 1/2019 | |
| CN | 107285159 | B | | 4/2019 | |
| CN | 107531451 | B | | 6/2020 | |
| CN | 112303152 | A | | 2/2021 | |
| EP | 0582805 | B1 | | 9/1996 | |
| EP | 1749784 | A1 | | 2/2007 | |
| EP | 1749785 | A1 | | 2/2007 | |
| EP | 1447369 | B1 | | 7/2008 | |
| EP | 2035313 | B1 | | 11/2010 | |
| EP | 2560910 | B1 | | 1/2015 | |
| EP | 2651809 | B1 | | 10/2015 | |
| EP | 2727871 | B1 | | 3/2016 | |
| EP | 3019428 | B1 | | 4/2017 | |
| EP | 3342740 | B1 | | 2/2020 | |
| EP | 2941399 | B1 | | 5/2020 | |
| WO | WO-03043926 | A1 | * | 5/2003 | ..... B66B 11/0045 |
| WO | WO-2015189652 | A1 | * | 12/2015 | ..... B66B 11/0045 |
| WO | WO-2016166563 | A1 | * | 10/2016 | ..... B66B 11/0045 |

* cited by examiner

ELEVATOR CAR WITH ELECTRONIC SAFETY ACTUATOR

FOREIGN PRIORITY

This application claims priority to European Patent Application No. 22382432.7, filed May 5, 2022, and all the benefits accruing therefrom under 35 U.S.C. § 119, the contents of which in its entirety are herein incorporated by reference.

TECHNICAL FIELD

This disclosure relates to an elevator car with electronic safety actuators.

BACKGROUND

It is known for elevator cars to include safety brakes. The function of the safety brake is to be triggered in the event of an emergency such as an elevator car over-speed (i.e., the elevator car travel speed exceeding a particular threshold). Once triggered, the safety brake engages with a guide rail in order to brake the motion of the elevator car.

Traditional safety brakes (often referred to simply as safeties) are located either at the top of the elevator car or at the bottom of the elevator car. Normally one is provided on either side of the elevator car. The safeties are usually mechanically synchronized by a linkage bar or similar mechanism that extends across the elevator car structure from one side to the other. One of the safeties is connected to a governor rope, such that over-speed of the elevator car will cause relative movement of the governor rope and a part of the safety, thereby triggering the safety to be engaged. Engagement of that safety will transfer motion to the safety on the opposite side of the elevator car, via the linkage bar, such that both safeties are triggered to engage.

In order to accommodate the mechanical linkage, the safety brakes must be located above the top of the cabin of the elevator car, thus requiring additional space to be provided in the overhead area (the space which must be provided in the hoistway above the elevator car) or below the bottom of the cabin of the elevator car, thus requiring additional space to be provided in the pit (the space which must be provided in the hoistway below the elevator car).

Different elevator systems have different priorities on space, i.e. whether it is more important to reduce overhead area or pit depth. Where the priority for an elevator system is the reduction of the pit depth, the safeties, their mechanical linkage and actuating elements are located at the top of the elevator car, so as to reduce space required in the pit. Conversely, if the priority is the reduction of the overhead space then the solution is to position the safeties and their ancillaries at the bottom of the elevator car.

However, in some buildings it is desirable, or even necessary to reduce the overhead dimensions as well as to reduce the pit dimensions so that architects and tenants can have more building space available.

The reduction in the overhead space is particularly attractive as it allows to remove or reduce protrusions from the top of the building. Having a small pit provides advantages such as reducing the cost of the building by reducing digging or breaking of structural building slabs. Additionally, it is also then possible to accommodate spaces like parking garages or corridors under the elevator hoistway.

SUMMARY

According to a first aspect of this disclosure there is provided an elevator car, comprising: a first safety brake, comprising a first electronic safety actuator, wherein the first safety brake is positioned on a first side of the elevator car at a first height; and a second safety brake, comprising a second electronic safety actuator, wherein the second safety brake is positioned on a second side of the elevator car at a second height; wherein the first height is different to the second height.

By providing two safety brakes which both include electronic safety actuators, it is possible for the brakes to be actuated together (i.e., synchronised) without requiring any mechanical linkage between the two safety brakes. Since no mechanical linkage is required, the safety brakes no longer need to be located at the top or the bottom of the elevator car (i.e. above or below the cabin). This allows the safeties to be located at a greater range of heights on the elevator car, since they are not limited to being positioned only at the top or bottom of the elevator car. Moreover, locating each of the safety brakes at different (i.e. asymmetrical) heights, gives greater versatility and convenience to other design factors.

Electronic safety actuators will be understood to be actuators which trigger application of a brake, based on receipt of an electronic signal, i.e., in contrast to mechanical safety actuators which are triggered to apply a brake by a mechanical action, such as motion caused by a governor cable. It will be understood that although the action of the safety brakes is preferably synchronised, there might be some small variation in timing between the operation of the safety brakes. Synchronisation simply requires that the actuators (and thus the brakes) are triggered by the same event or control signal (e.g., an electronic signal from an over-speed sensor), such that they will be operated at approximately the same time.

It will furthermore be appreciated that the first safety brake and the second safety brake may be of different designs, but are in some examples substantially the same so as to ensure identical or near-identical operation.

It will be understood that the "height" refers to distance along a vertical length of the elevator car. It will furthermore be understood that an elevator car may be configured to travel within a hoistway, and that the height may be defined as the distance along the travel direction of the elevator car within the hoistway. Thus the floor of the elevator cabin is at a low height while the ceiling of the elevator cabin is at a large height.

The first side and the second side of the elevator car may be opposing sides of the elevator car.

In some examples, the first height is located within a central region of the overall height of the elevator car. For example, the first height may be at approximately the mid-point of the overall height of the elevator car or it may be within a certain range from the mid-point of the overall height of the elevator car, e.g. such that the first height lies within the central three-quarters of the overall height of the elevator car. Thus it will be understood that the first safety brake is located away from the extremes of the elevator car height, i.e., not at or close to the top or bottom of the elevator car. For example, the first height may be at least 50 cm from either the top or bottom of the elevator car, optionally at least 1 m, further optionally at least 1.5 m. As the first safety brake is positioned at a distance from either of the top or bottom of the elevator car, there is more room for the elevator car to overlap with other components in the hoistway when the car is at the uppermost or lowermost position in the hoistway. Thus equipment or components that would previously have been located in the headspace or in the pit can now be located alongside the elevator car without colliding with a safety. This allows reduction in the overhead space and/or the pit depth.

In some examples, in addition or alternatively, the second height is at the top of the elevator car, or at the bottom of the elevator car. It will be understood that by "at" the top or bottom it is meant that the second height is close to or indeed exactly at the top or bottom, e.g., within 50 cm of the top or bottom, further optionally within 30 cm. The advantage of such locations is that the second safety device can be accessed from either above or below the elevator car (corresponding to whether it is positioned at the top or bottom of the elevator car) allowing easy maintenance from the top of the car or from the pit without requiring access to the second safety device to be provided via an access panel or hatch from inside the elevator car.

The combination of the first safety brake being located at a central height on the elevator car, and the second safety brake being located at one of the extremes of the height of the elevator car is particularly advantageous. It provides a good compromise between economic space design, since the location of the first safety brake can allow components to be positioned more conveniently within the hoistway, and accessibility, since the second safety device can be easily accessed for maintenance.

In some examples, the first height and the second height are separated by a height (i.e., a distance along the travel direction) of at least 30 cm, optionally at least 50 cm, further optionally at least 1 m.

In some examples, the elevator car further comprises an access panel, wherein the access panel is positioned such that the first safety brake is accessible from an interior of the elevator car when the access panel is opened. The access panel may be on a first side of the elevator car. The second safety brake may be accessible from an exterior of the elevator car, e.g., from above or below the elevator car as described above. Thus, in some examples, the first safety brake is accessible from an interior of the elevator car when the access panel is opened, and the second safety brake is accessible without requiring access through an access panel. It is advantageous that the second safety brake can be accessed without requiring an access panel, since access panels are generally undesirable and can be problematic, for aesthetic and safety reasons. For example, an access panel needs to be designed to be openable only by authorised maintenance personnel so that ordinary users cannot accidentally or intentionally gain access to the hoistway which could be dangerous.

In some examples, the first height and the second height are both located in an upper half of the elevator car (i.e., at a height that is in the top half of the height of the elevator car). The first height and the second height may both be located above a centre of gravity of the elevator car, or at least above the expected centre of gravity of the elevator car during normal usage. The centre of gravity of the elevator car may vary with load (e.g. number of persons in the car and/or equipment loaded into the car for transport). Such variation will normally result in a lower centre of gravity. However, the centre of gravity may move upwards if weight is added to the top of the elevator car, e.g. for maintenance.

In other examples, the first height and the second height are both located in the lower third of the elevator car. The first height and the second height may both be located below a centre of gravity of the elevator car, or at least below the expected centre of gravity of the elevator car during normal usage.

In some examples, the first safety brake comprises a first braking portion and the second safety brake comprises a second braking portion, the braking portions configured to brake motion of the elevator car.

It will be understood that braking portions of elevator safety brakes can generally be divided into two types—symmetric and asymmetric. Symmetric brakes comprise two moving portions, located on opposing sides of the guide rail which, when actuated, both move towards each other, and therefore towards the guide rail, until they contact the guide rail and brake against the guide rail. Asymmetric brakes comprise one moving portion which is actuated to move towards the guide rail and one fixed portion. In order to brake against the guide rail, the moving portion is first moved into contact with the guide rail, then further actuation causes the fixed portion and thus the whole asymmetric brake must then shift laterally a small amount, relative to the guide rail, so that the moving part of the brake and also a brake surface of the fixed portion both contact the guide rail. The fixed portion may be fixed to the elevator car so that the whole car moves during the braking motion, or the safety brake may be a floating brake that moves relative to the car while still retaining contact to transfer the braking force to the car.

In some examples, the first braking portion and the second braking portion are symmetric brakes. In other examples, at least one (and optionally both) of the first braking portion and the second braking portion are asymmetric brakes.

The positioning of both safety brakes either above the centre of gravity or below the centre of gravity (e.g., both in the upper half or both in the lower third) is particularly advantageous where the safety brakes comprise asymmetrical braking portions. The asymmetrical brakes need some lateral movement to allow engagement of the brake, and (especially when the brakes are not of the floating kind) this lateral movement could cause a reaction force on the elevator car where the safety brakes are located at heights which are far apart and on either side of the centre of gravity of the elevator car. This effect is reduced or even avoided by placing both of the safety brakes either above or below the centre of gravity of the elevator car.

According to a second aspect of this disclosure there is provided an elevator system, comprising: an elevator car having any of the features as described above; a hoistway; a first guide rail, located on a first side of the hoistway; a second guide rail, located on a second, opposite side of the hoistway; wherein the elevator car is arranged to travel along the hoistway on the guide rails and wherein the first safety brake and the second safety brake each comprise a respective braking portion, configured to engage with the respective first and second guide rails to brake motion of the elevator car.

In some examples, the elevator system further comprises an elevator system component positioned on the first side of the hoistway at the top or bottom of the hoistway, wherein the first side of the elevator car is adjacent to the first side of the hoistway; wherein the elevator car has a vertical overlap with the elevator system component when the elevator car is in its uppermost or lowermost position within the hoistway; and wherein the first height is such that the first safety brake is positioned between the elevator system component and a vertical mid-height of the hoistway when the elevator car and the elevator system component are vertically overlapped.

The vertical mid-height of the hoistway is the mid-point of the height of the hoistway. The vertical mid-height is used here merely as a convenient point of reference by which to define the relative arrangement of the elevator component and the first safety brake. In these examples, the first safety brake is located "inwardly" of the elevator system component, i.e. closer to the mid-height of the hoistway. Thus it will be understood by this that when the elevator car has a vertical overlap with the elevator system component when the elevator car is in its lowermost position (i.e. when the elevator component is at the bottom of the hoistway), the first height is such that the first safety brake is positioned above the elevator system component. Conversely, when the elevator car has a vertical overlap with the elevator system component when the elevator car is in its uppermost position (i.e. when the elevator component is at the top of the hoistway), the first height is such that the first safety brake is positioned below the elevator system component.

By such positioning of the first safety brake, the elevator car can overlap vertically with an elevator system component while avoiding a collision between the first safety brake and the elevator system component. This allows one or more components that would have been located in the overhead space or in the pit to be located to the side of the elevator car in overlap with the elevator car, i.e., the vertical extents of the elevator system component and the elevator car can be arranged at least partly in parallel rather than in series.

In some examples, the elevator system component comprises one or more of: an elevator machine (e.g., a motor), a sheave, one or more dead end hitches, a governor rope and/or governor mechanism, electrical system components and/or supporting structures. It is advantageous that the positioning of the first safety brake on the elevator car provides space in the hoistway to locate such elevator system components so that no machine-room (or a much smaller machine room) is required and/or such that no pit (or a much smaller pit) is required, and the overall space occupied by the elevator system can be reduced. In some examples the elevator system is a machine-room-less elevator system.

In some examples the elevator system is a low-pit elevator system, also referred to as a reduced pit or shallow pit elevator system. In some examples the elevator system is a low-overhead elevator system. Where the elevator system is both low-pit and low-overhead it is particularly difficult to locate all the components of the elevator system satisfactorily, and therefore the above described height arrangement of safety brakes can be particular advantageous.

The second safety brake could also be away from the extremes of the elevator car, to avoid collisions with other components of the elevator system, but as described above in some examples the second safety brake is located close to the top or bottom of the elevator car, which has the advantage of allowing the second safety brake to be easily and conveniently accessed, e.g., for maintenance.

In some examples the elevator system, and optionally the elevator car, further comprises at least one sensor (e.g., an over-speed sensor), arranged to send an electronic signal to each of the first safety brake and the second safety brake, to trigger the respective braking portions to engage with the respective first and second guide rails. The sensor can be of any suitable type which is able to detect a condition of the elevator system in which the safety brakes should be applied, for example an optical sensor arranged to detect a visible feature in the hoistway from which speed can be determined (e.g., a marked tape) or an accelerometer. In other examples the sensor may detect other dangerous situations such as a break in the safety chain and/or an open landing door and/or a person detected in the hoistway. In each of these examples the signal is transmitted to the first and second safety brakes electrically and without the need for a mechanical link between the first and second safety brakes.

In some examples the first safety brake may be the uppermost safety brake on the first side and the second safety brake may be the uppermost safety brake on the second side. In other examples the first safety brake may be the lowermost safety brake on the first side and the second safety brake may be the lowermost safety brake on the second side. In examples where the elevator car has a plurality of safety brakes on each side, at least one pair of safety brakes selected from the pair of uppermost safety brakes and the pair of lowermost safety brakes will have the safety brakes of that pair at different heights. Thus the uppermost safety brake on the first side may be at a different height from the uppermost safety brake on the second side and/or the lowermost safety brake on the first side may be at a different height from the lowermost brake on the second side.

In other examples, there is only one first safety brake on the first side and only one second safety brake on the second side.

In some examples, the elevator car further comprises: a first guide element, positioned on the first side of the elevator car at a first guide element height; and a second guide element, positioned on the second side of the elevator car at a second guide element height; wherein the first guide element height is different to the second guide element height.

According to a third aspect of the present disclosure, there is provided an elevator car, comprising: a first guide element, positioned on a first side of the elevator car at a first guide element height; and a second guide element, positioned on a second side of the elevator car at a second guide element height; wherein the first guide element height is different to the second guide element height.

The guide element is a separate component of the elevator system, which attaches to the elevator car, and contacts the guide rail either through a sliding contact or via rollers. Thus the guide element may be a guide shoe or a guide roller, or the elevator car may even include a combination of both guide shoes and guide rollers (e.g. guide rollers at the bottom and guide shoes at the top or vice versa). It helps to guide the elevator car as it runs up and down the guide rails. Location of the guide elements at different heights allows additional freedom of design for an elevator system in the same way as has been described above for safety brakes, i.e. positioning them so as to allow overlap with other system components in the hoistway without collision. It will be appreciated that all of the preferred and optional features described above in relation to the position of the safety brakes may also be applied to the position of the guide elements.

In some examples the first guide element is located in proximity to the first safety brake, i.e., it is located close to or at the first height. In some examples, in addition or alternatively, the second guide element is located in proximity of the second safety brake, i.e., it is located close to or at the second height. This allows the guide elements to be accessed together with the safety brakes, i.e., when a maintenance person is at a position which allows maintenance of a safety brake they will also be able to carry out maintenance for the corresponding guide element. This increases convenience for a maintenance person, and saves time.

DRAWING DESCRIPTION

Certain preferred examples of this disclosure will now be described, by way of example only, with reference to the accompanying drawings, in which.

DETAILED DESCRIPTION

Figure 1:
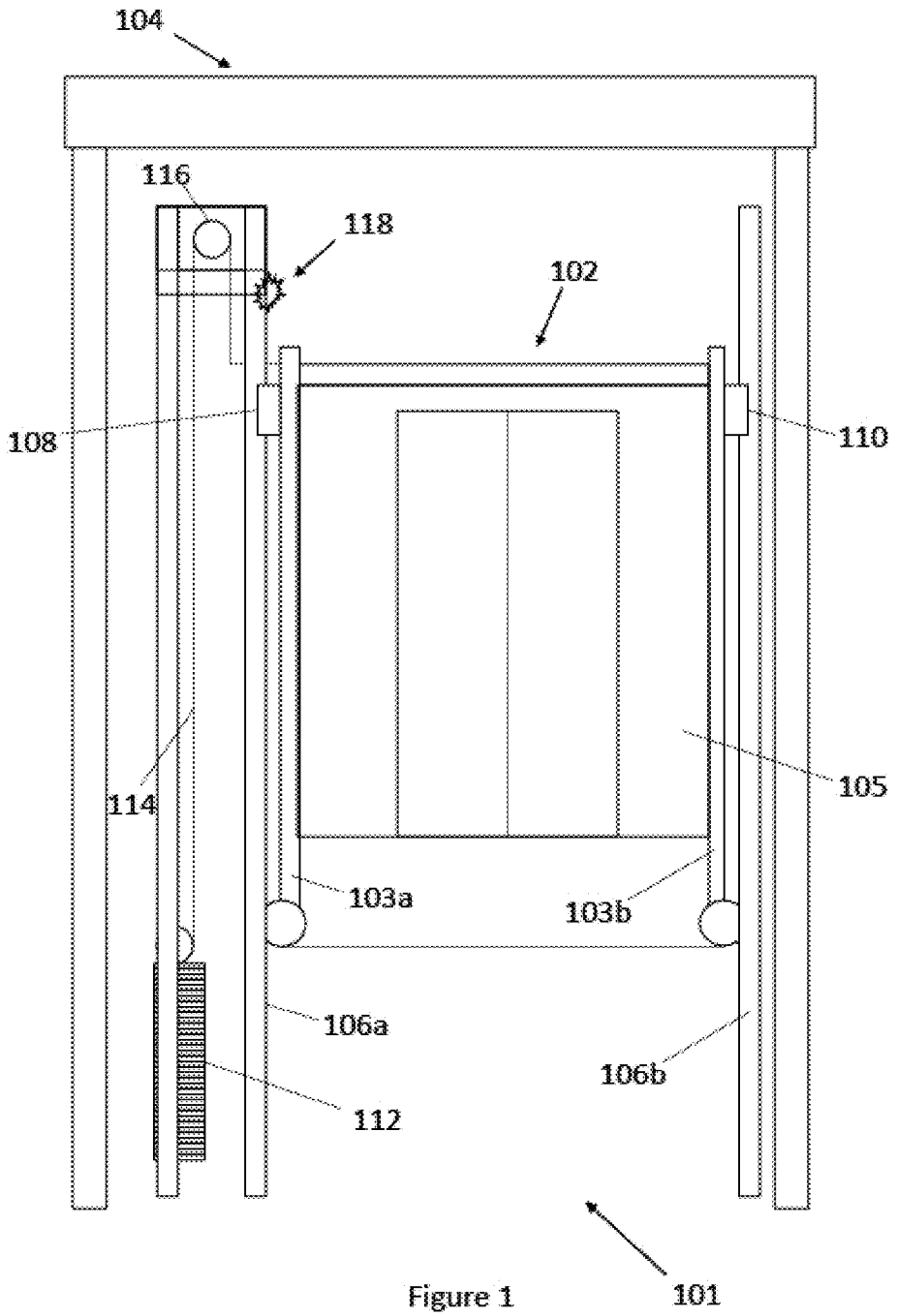
FIG. 1 shows a schematic drawing of an elevator system according to the prior art.

FIG. 1 shows an elevator system 101 according to the prior art. The elevator system 101 includes an elevator car 102 which is arranged to travel within a hoistway 104. The elevator car 102 travels along a first guide rail 106*a*, which is located on a first side of the hoistway 104, and a second guide rail 106*b*, which is located on a second, opposite side of the hoistway 104.

The elevator car 102 includes a frame with two uprights 103*a*, 103*b* and a cabin 105 mounted to the frame 103*a*, 103*b*. A first safety brake 108 is positioned on a first side of the elevator car 102 (e.g., on the upright 103*a*) and a second safety brake 110 is positioned on a second side of the elevator car 102 (e.g., on the upright 103*b*). In this known elevator car 102, the first safety brake 108 and the second safety brake 110 are located at the same height at the top of the elevator car 102.

The elevator car 102 is connected to a counterweight 112 by one or more tension members 114. The tension member is driven by a machine 116 to drive motion of the elevator car 102 and the counterweight 112. As the machine 116 drives the elevator car 102 up towards the top of the hoistway 104, the first safety device 108 will move towards the machine 116. This creates a collision zone 118 in which the elevator car 102 is prevented from moving any further up the hoistway 104 due to a risk of the first safety device 108 contacting the machine 116. As a result, space at the top of the hoistway 104 is wasted, and the hoistway must be made taller in order to allow the elevator car 102 to reach a desired height.

Figure 2:
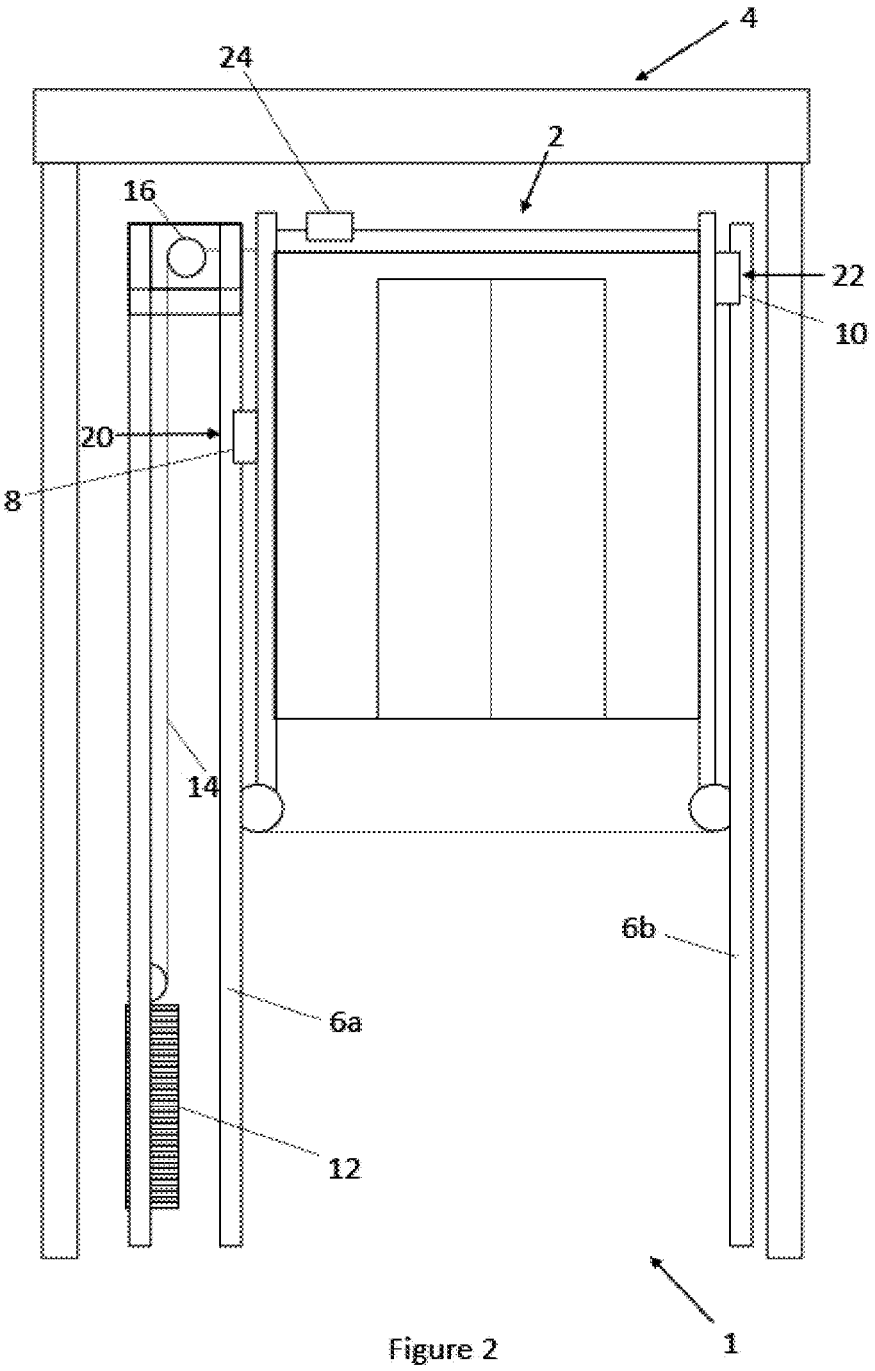
FIG. 2 shows a schematic drawing of an elevator system according to a first example of a second aspect of the present disclosure.

FIG. 2 shows an elevator system 1 according to the present disclosure. The elevator system 1 includes an elevator car 2 which is arranged to travel within a hoistway 4. The elevator car 2 travels along a first guide rail 6*a*, which is located on a first side of the hoistway 4, and a second guide rail 6*b*, which is located on a second, opposite side of the hoistway 4.

The elevator car 2 includes a first safety brake 8, positioned on a first side of the elevator car 2. The first side of the elevator car 2 is adjacent to the first side of the hoistway 4. The first safety brake 8 is located at a first height 20. In this example the first height 20 is in the mid-region of the height of the elevator car 2, i.e. within the central three-quarters of the overall height of the elevator car 2.

The elevator car 2 also includes a second safety brake 10 positioned on a second side of the elevator car 2. The second side of the elevator car 2 is adjacent to the second side of the hoistway 4. The second safety brake 10 is located at a second height 22, where the second height 22 is different (and in this example higher) than the first height 20.

The elevator car 2 is connected to a counterweight 12 by one or more tension members 14. The tension member 14 is driven by a machine 16 to drive motion of the elevator car 2 and the counterweight 12. The machine 16 is one example of an elevator system component. As a result of locating the first safety brake 8 at a first height 20 which is in the mid-region of the height of the elevator car 2, the elevator car 2 can be driven all the way to the top of the guide rails 6*a*, 6*b* without any risk of the first safety brake 8 colliding with the machine 16. Thus the overhead space required in the hoistway 4 above the elevator car 2 can be reduced.

The elevator system 1 includes an electronic over-speed sensor 24, mounted on the elevator car 2, and arranged to trigger engagement of each of the safety brakes 8, 10, if an over-speed of the elevator car 2 is detected. For example, the electronic over-speed sensor 24 may send an electronic signal to an electronic board which commands triggering of the safety brakes 8, 10. Thus the safety brakes 8, 10 are electronic safety brakes. In one example, the electronic over-speed sensor 24 may be arranged to read signals from the hoistway (e.g. on a stationary element mounted in the hoistway, e.g. markings or other detectable areas on a tape or rail in the hoistway).

Figure 3:
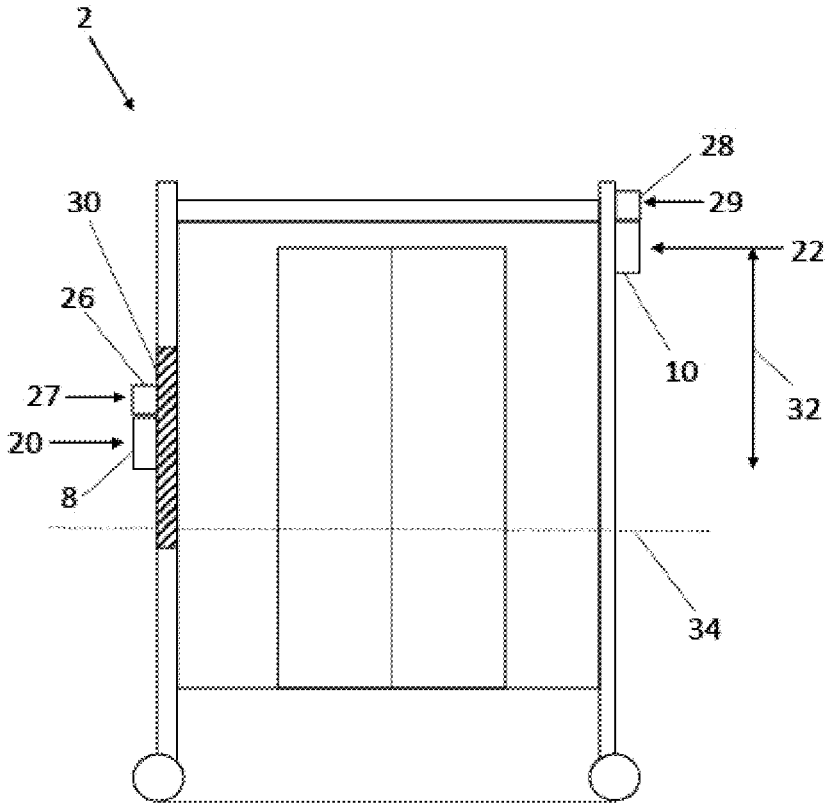
FIG. 3 shows a front view of the elevator car shown in FIG. 2.

FIG. 3 shows the elevator car 2 of FIG. 2 in greater detail.

It can be seen that the elevator car 2 in FIG. 3 further includes a first guide element 26, located in proximity to the first safety brake 8 (i.e., close to the first height 20) at a first guide element height 27 and a second guide element 28, located in proximity to the second safety brake 10 (i.e., close to the second height 22), at a second guide element height 29. In this particular example the first guide element 26 and the second guide element 28 are guide shoes. The guide elements 26, 28 attach to the elevator car 2 and help it to run up and down the guide rails 6*a*, 6*b* when it travels within the hoistway 4. Guide elements 26, 28 may slide on the guide rails 6*a*, 6*b* or they may have rollers that roll along guide rails 6*a*, 6*b*.

Although FIG. 2 only shows a single guide element 26, 28 on each side of the elevator car 2, in many examples there are two guide elements 26, 28 on each side of the elevator car, e.g. an upper guide element 26, 28 and a lower guide element 26, 28. Where there are two guide elements on each side, at least one pair of these guide elements 26, 28, e.g. the upper pair or the lower pair may be positioned adjacent to the first and second safety brakes 8, 10.

The elevator car 2 further includes an access panel 30, which is illustrated schematically, located on the first side of the elevator car 2. The access panel 30 can be opened from the interior of the elevator car 2, e.g., by a maintenance person, and is positioned so that the first safety brake 8 and the first guide element 26 are accessible from an interior of the elevator car 2 when the access panel 30 is opened, allowing easy access for maintenance.

The first height 20 of the first safety brake 8 and the second height 22 of the second safety brake 10 are separated by a certain vertical distance (i.e., height) 32. In this example the distance 32 is approximately 1 m.

The elevator car 2 has a centre of gravity, which is at a height 34 illustrated by a dashed line. It will be understood that this is the approximate centre of gravity of the elevator car during normal or standard usage. It may shift upwards if weight is added to the top of the elevator car above the line 34, e.g. for maintenance, or downwards if a large amount of weight is added inside the elevator car below the line 34. Both of the safety brakes 8, 10 are positioned in an upper half of the elevator car 2. As the centre of gravity 34 is in the lower half of the elevator car 2, both safety brakes 8, 10 are necessarily above the centre of gravity 34. This is advantageous since it helps to prevent any moment or reaction force from acting on the elevator car 2 as a result of the safety brakes 8, 10 applying braking forces at different heights. This is particularly beneficial when the safety brakes 8, 10 include a braking portion which is asymmetrical, as discussed further below.

Figure 4:
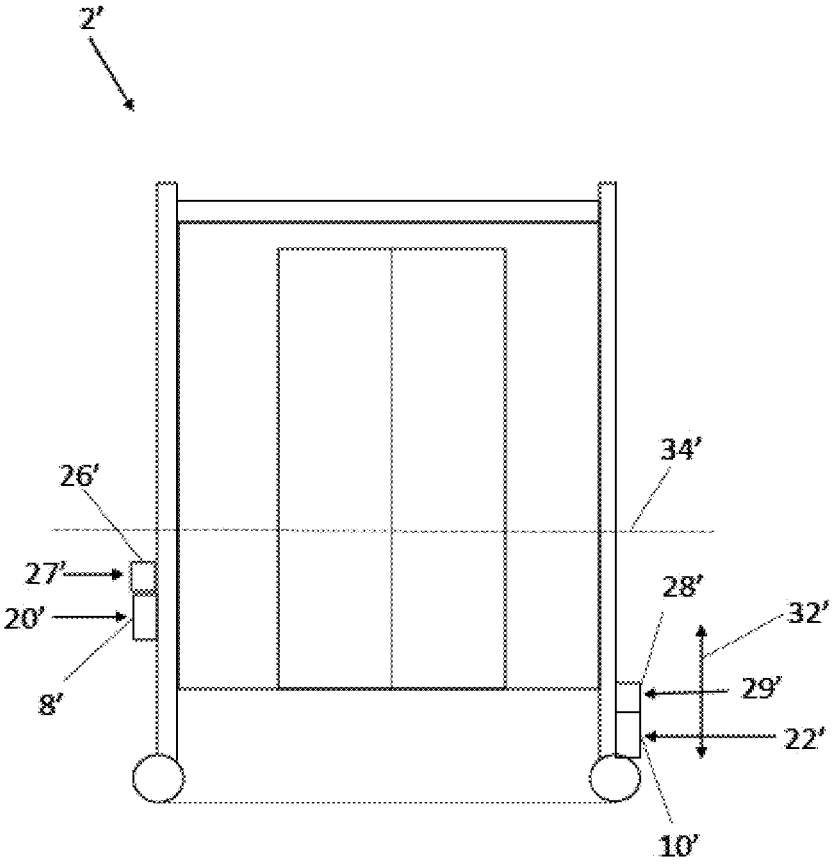
FIG. 4 shows a front view of an elevator car according to a second example of a first aspect of the present disclosure.

FIG. 4 shows an alternative elevator car 2', according to a second example of the present disclosure. Like components of the elevator car 2' are labelled with the same reference numerals used for the elevator car 2 of FIG. 3, but followed by an apostrophe, for example 2 in FIG. 3 is labelled as 2' in FIG. 4. The elevator car 2' includes a first safety brake 8', located at a first height 20', and a second safety brake 10' located at a second, different height 22'.

In this example the first height 20' is approximately one quarter of the height of the elevator car 2' above the bottom of the elevator car 1, whilst the second height 22' is located at the bottom of the elevator car 2'. The first height 20' of the first safety brake 8' and the second height 22' of the second safety brake 10' are separated by a distance 32' of approximately 50 cm.

The elevator car 2' has a centre of gravity, which is at a height 34' illustrated by a dashed line. It will be understood that this is the approximate centre of gravity of the elevator car 2' during normal or standard usage. It may shift upwards if weight is added above the line 34', e.g. to the top of the elevator car for maintenance, or downwards if a large amount of weight is added inside the elevator car below the line 34'. Both of the safety brakes 8', 10' are positioned in the lower third of the elevator car, and are both below the centre of gravity 34'. This is advantageous since it helps to prevent any moment or reaction force from acting on the elevator car 2' as a result of the safety brakes 8', 10' applying braking forces at different heights. This is particularly beneficial when the safety brakes 8' 10' include a braking portion which is asymmetrical, as discussed further below.

It can be seen that the elevator car 2' in FIG. 4 further includes a first guide element 26', located in proximity to the first safety brake 8' (i.e., close to the first height 20') at a first guide element height 27' and a second guide element 28', located in proximity to the second safety brake 10' (i.e., close to the second height 22'), at a second guide element height 29'. In this particular example the first guide element 26' and the second guide element 28' are guide shoes. The guide elements 26', 28' attach to the elevator car 2' and help it to run up and down the guide rails 6*a*', 6*b*' when it travels within the hoistway 4'. Guide elements 26', 28' may slide on the guide rails 6*a*', 6*b*' or they may have rollers that roll along guide rails 6*a*', 6*b*'.

Figure 5:
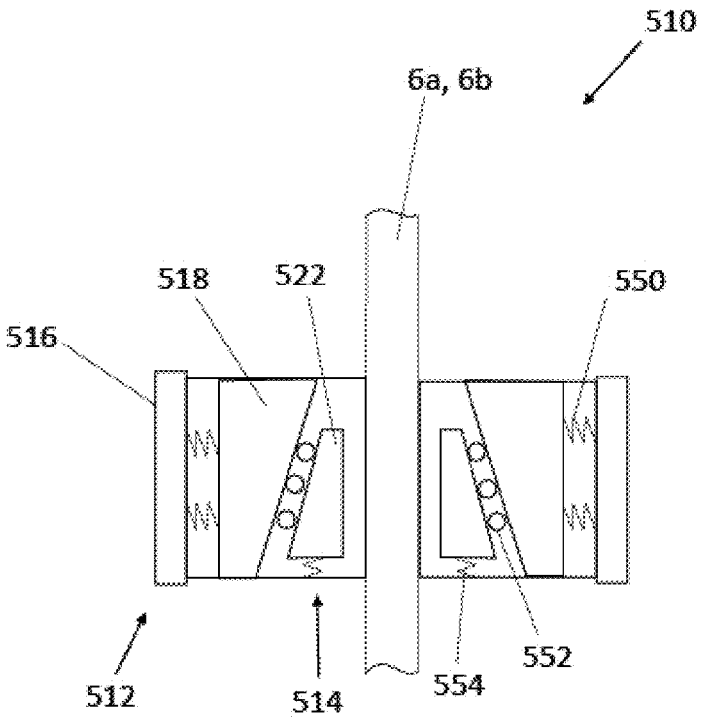
FIG. 5 shows a cutaway side view of a symmetrical safety brake, which may provide the safety brake according to this disclosure.
Figure 6:
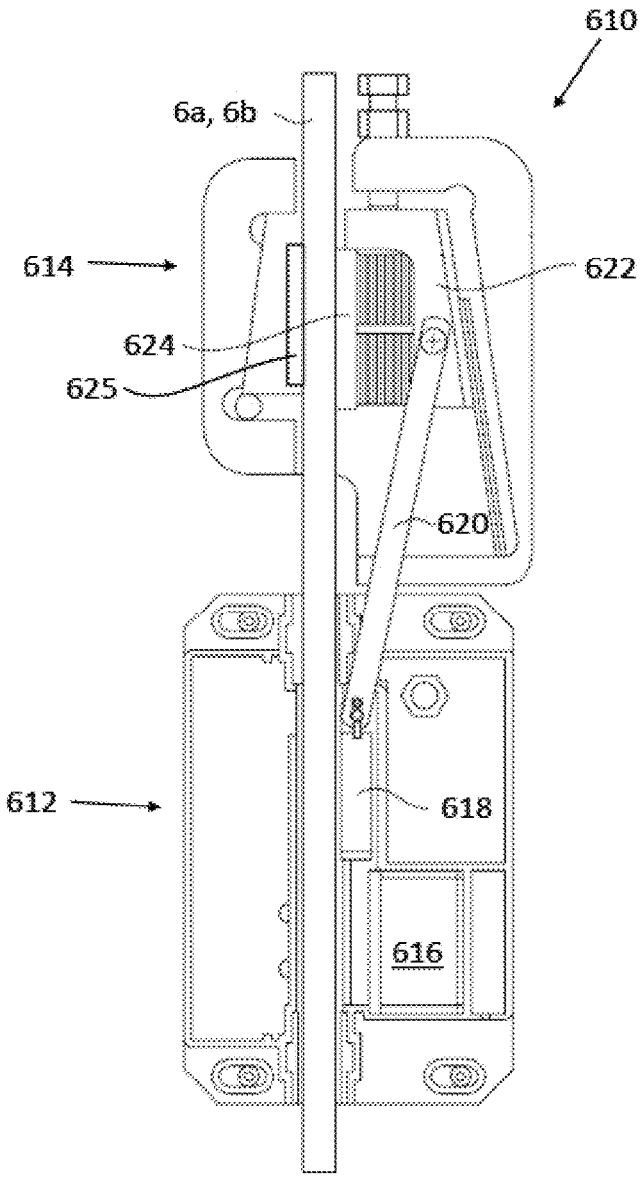
FIG. 6 shows a cutaway side view of an asymmetrical safety brake, which may provide the safety brake according to this disclosure.

The safety brakes 8, 10, 8', 10' may, for example, be of the types illustrated in either of FIGS. 5 and 6. In this example the safety brakes are both of the same type (i.e., either both asymmetrical or both symmetrical).

FIG. 5 shows a symmetric safety brake 510, including an electronic safety actuator 512 and a braking portion 514. The safety brake 510 is arranged symmetrically on either side of the guide rail 6*a*, 6*b*. The operation of only one side of the safety brake 510 will be described, but it will be understood that this process will occur simultaneously on each side of the safety brake 510. The electronic safety actuator 512 includes an electromagnetic component 516 and a magnetic portion 518. The magnetic portion 518 is biased by springs 550 either towards or away from the electromagnet 516. When the electromagnet 516 receives an appropriate electronic signal it energises or de-energises (depending on the biasing of the springs), so as to drive the magnetic portion 518 towards the guide rail 6*a*, 6*b*, either by magnetic forces acting against the biasing force of the springs 550, or by the biasing force of the springs 550 no longer resisted by a magnetic force.

The magnetic portion 518 contacts a wedge portion 522 of the braking portion 514 via rollers 552. As a result of this contact the magnetic portion 518 slides the wedge portion 522, along an angled surface of the magnetic portion 518, moving the wedge portion 522 upwards, against the biasing of another spring 554, and also towards the guide rail 6*a*, 6*b*. This occurs on either side of the guide rail 6*a*, 6*b* so that wedge portions 522 on both sides of the guide rail 6*a*, 6*b* will contact the guide rail 6*a*, 6*b* simultaneously, and symmetrically, to brake on both surfaces of the guide rail 6*a*, 6*b*. This type of safety brake 510 (or specifically the braking portion 514) is therefore referred to as "symmetrical".

FIG. 6 shows an asymmetric safety brake 610, including an electronic safety actuator 612 and a braking portion 614. The electronic safety actuator 612 includes an electromagnetic component 616 and a magnetic brake 618. The magnetic brake 618 is selectively deployed by operation of the electromagnetic component 616 to contact the guide rail 6*a*, 6*b*, and is shown in FIG. 6 in the deployed position where it has moved away from the electromagnetic component 616 and contacts the guide rail 6*a*, 6*b*.

As a result of engaging the guide rail 6*a*, 6*b*, during movement of the elevator car 2, 2', the magnetic brake 618 is moved upward with the guide rail 6*a*, 6*b* relative to the descending elevator car 2, 2'. The electronic safety actuator 612 is operably coupled to a wedge-shaped portion 622 by a rod or linkage bar 620. The magnetic brake 618, in the rail-engaging position, pushes the wedge-shaped portion 622 in an upward direction due to the relative upward movement of the magnetic brake 618 relative to the descending elevator car 2, 2' and fixed brake portion 614 which is fixed to the elevator car 2, 2'. This upward motion slides the wedge-shaped portion 622 along an angled interior surface of the fixed brake portion 614 until safety brake pad 624 contacts the guide rail 6*a*, 6*b*. Then further upward motion draws the fixed brake portion 614 over to the right (from the perspective of FIG. 6), so that a safety brake pad 625 engages with the guide rail 6*a*, 6*b*. Since there is only movement of one wedge-shaped portion, towards one side of the guide rail 6*a*, 6*b*, and as contact occurs first on one side only, then later on the opposite side, this type of safety brake 610 is referred to as "asymmetrical".

As an alternative to the symmetric arrangement shown in FIG. 5, an alternative symmetric brake arrangement could be provided which is similar to the brake shown in FIG. 6, but further including an internal interlocking element, which is arranged so that the two wedges or braking elements move in synchronicity. It will of course be appreciated that many other symmetrical and asymmetrical braking arrangements are possible.

It will be appreciated that the specific forms of brakes shown in FIGS. 5 and 6 are merely be way of illustration of the two types of brake and that many other symmetrical and asymmetrical brake arrangements are known and can be used here instead.

It will be appreciated by those skilled in the art that the disclosure has been illustrated by describing one or more specific aspects thereof, but is not limited to these aspects; many variations and modifications are possible, within the scope of the accompanying claims.

What is claimed is:

1. An elevator system (1), comprising:

an elevator car (2) including:

a first safety brake (8, 8'), comprising a first electronic safety actuator (512, 612), wherein the first safety brake (8, 8') is positioned on a first side of the elevator car (2, 2') at a first height (20, 20'); and a second safety brake (10, 10'), comprising a second electronic safety actuator (512, 612), wherein the second safety brake (10, 10') is positioned on a second side of the elevator car (2, 2') at a second height (22, 22');

wherein the first height is different to the second height;

a hoistway (4);

a first guide rail (6*a*), located on a first side of the hoistway (4);

a second guide rail (6*b*), located on a second, opposite side of the hoistway (4);

wherein the elevator car (2) is arranged to travel along the hoistway (4) on the guide rails (6*a*, 6*b*) and wherein the first safety brake (8) and the second safety brake (10) each comprise a respective braking portion (514, 614), configured to engage with the respective first and second guide rails (6*a*, 6*b*) to brake motion of the elevator car (2);

an elevator system component (16) positioned on the first side of the hoistway (4) at the top or bottom of the hoistway (4), wherein the first side of the elevator car (2) is adjacent to the first side of the hoistway (4);

wherein the elevator car (2) has a vertical overlap with the elevator system component (16) when the elevator car (2) is in its uppermost or lowermost position within the hoistway (4); and wherein the first height (20) is such that the first safety brake (8, 8') is positioned between the elevator system component (16) and a vertical mid-height of the hoistway (4) when the elevator car (2) and the elevator system component (16) are vertically overlapped such that no safety brake is positioned at the same height as the elevator system component (16) when the elevator car (2) is in its uppermost or lowermost position within the hoistway (4).

2. An elevator system as claimed in claim 1, wherein the first height (20) is located within a central region of the overall height of the elevator car (2).

3. An elevator system as claimed in claim 1, wherein the second height (22) is at the top of the elevator car.

4. An elevator system as claimed in claim 1, further comprising an access panel (30), wherein the car panel (30) is positioned such that the first safety brake (8) is accessible from an interior of the elevator car (2) when the car panel is opened.

5. An elevator system as claimed in claim 1, wherein the first height (20, 20') and the second height (22, 22') are separated by a height (32, 32') of at least 1 metre.

6. An elevator system as claimed in claim 1, wherein the first height (20) and the second height (22) are both located in an upper half of the elevator car.

7. An elevator system as claimed in claim 1, wherein the first height (20') and the second height (22') are both located in the lower third of the elevator car (2').

8. An elevator system as claimed in claim 1, wherein the first safety brake (8, 8') comprises a first braking portion (514, 614) and the second safety brake comprises a second braking portion (514, 614), the braking portions configured to brake motion of the elevator car (2, 2'), wherein at least one of the first braking portion (614) and the second braking portion (614) is an asymmetric brake.

9. An elevator system as claimed in claim 1, further comprising:

a first guide element (26, 26'), positioned on the first side of the elevator car (2, 2') at a first guide element height (27, 27'); and a second guide element (28, 28'), positioned on the second side of the elevator car (2, 2') at a second guide element height (29, 29');

wherein the first guide element height (27, 27') is different to the second guide element height (29, 29').

10. An elevator system as claimed in claim 9, wherein the first guide element (26) is located in proximity to the first safety brake (8) and wherein the second guide element (28) is located in proximity to the second safety brake (10).

11. An elevator system (1) as claimed in claim 1, further comprising at least one sensor (24), arranged to send an electronic signal to each of the first safety brake (8, 8') and the second safety brake (10, 10'), to trigger the respective braking portions (514, 614) to engage with the respective first and second guide rails (6*a*, 6*b*).

12. An elevator system (1) as claimed in claim 1, wherein the elevator system (1) is a machine-room-less elevator system.

* * * * *